United States Patent [19]

Guay

[11] 4,254,710

[45] Mar. 10, 1981

[54] LINK-LOC CHAINLESS HAULAGE SYSTEM

[75] Inventor: Paul J. Guay, Stoughton, Mass.

[73] Assignee: The United States of America as represented by the Secretary of the Interior, Washington, D.C.

[21] Appl. No.: 958,594

[22] Filed: Nov. 7, 1978

[51] Int. Cl.[3] ..... B61B 13/00

[52] U.S. Cl. ..... 104/165; 105/29 R; 198/728; 198/833

[58] Field of Search ..... 104/165; 105/29 R; 198/833, 779, 728, 734

[56] References Cited

U.S. PATENT DOCUMENTS

| | | | |
|---|---|---|---|
| 2,717,548 | 9/1955 | Blair, Jr. | 198/728 |
| 2,790,539 | 4/1957 | Duncan | 198/728 |
| 2,816,453 | 12/1957 | Frank et al. | 198/833 |
| 3,484,927 | 12/1969 | Smerd et al. | 198/728 |
| 3,893,564 | 7/1975 | Raynor et al. | 198/833 |
| 4,082,361 | 4/1978 | Lanfermann | 105/29 R |

FOREIGN PATENT DOCUMENTS

| | | | |
|---|---|---|---|
| 1400222 | 7/1975 | United Kingdom | 104/165 |

*Primary Examiner*—David M. Mitchell
*Assistant Examiner*—Ross Weaver
*Attorney, Agent, or Firm*—Thomas Zack; Donald A. Gardiner

[57] ABSTRACT

A chainless haulage system having at least three pairs of sprocket wheels, each pair disposed on a separate axle with opposed wheels on each axle aligned in a pair of parallel planes. Two pairs of sprocket wheels are disposed laterally offset from each other and serve as follower sprocket wheels, while a third pair is driven by conventional means. A pair of endless drive chains each having adjacent chain links in generally perpendicular planes respectively engage sprocket wheels disposed in the parallel planes to form a double strand of drive chain. The two endless drive chains are interconnected by a plurality of crossbars, each of which is formed of a pair of opposed chain links integrally connected by a connecting bar, the chain links of the cross bar inserted in series with the links of the endless drive chain. A hollow cylindrical roller is loosely disposed around the connecting bar of the cross bar. The sprocket wheels, the endless drive chains, and the cross bars are contained in a housing which at the bottom of the housing running the entire length thereof includes two guide bars. A plurality of contact pins are disposed in a line along the mine face. These contact pins are received between the housing guide bars, and as the endless drive chains are driven around the pairs of sprocket wheels, the contact pins are engaged by the cross bars, thereby propelling the housing.

6 Claims, 4 Drawing Figures

LINK-LOC CHAINLESS HAULAGE SYSTEM

BACKGROUND OF THE INVENTION

1. Field of the Invention

This invention relates to a chainless haulage system for pulling various mining machines along a long wall coal mining face.

2. Description of the Prior Art

Coal getting machines for long wall mining have historically been pulled along the coal seam face by means of a chain stretched along the entire length of the long wall face. However, the energy stored by a machine haulage chain under tension is a potential danger that has tended to increase in recent years with the trend towards multi-machine working and the use of higher horse power machines on the face. Although devices have been developed to limit tensions in chains and to release these chains safely in the event of machine stalling, nevertheless the severity of the mining operation has resulted in breakage of the chain which has produced serious injury to machine operators and distruction of mining equipment. Accordingly, in recent years effort has been directed to developing an alternate means of driving a power loader along the mine face completely eliminating the haulage chain previously employed.

In recent years therefore several chainless haulage systems have been developed to pull and track coal getting machines off the line of face conveyor pan sections. Several of this type chainless haulage systems are described by Braisby et al., "Review of Chainless Haulage Systems" Colliery Gardian, November, 1976, pages 577–586. For the most part, however, recent chainless haulage systems are based on some form of the rack and pinion principle. Therefore these systems are inherently pitch sensitive and unable to accommodate misalignment of the element forming the "rack". Also, the recently developed systems of the prior art are based on "push-pull" cylinders, and require good alignment of guide rails associated with these systems.

Examples of recently developed mining haulage systems can also be found in U.S. Pat. Nos. 3,954,300; 4,006,937; 4,025,120; and 4,055,367.

SUMMARY OF THE INVENTION

Accordingly, one object of this invention is to provide a novel chainless haulage system exhibiting improved reliability.

A further object of this invention is to provide a novel chainless haulage system which promotes safe operation thereof.

Yet another object of this invention is to provide a novel chainless haulage system providing high propulsion forces for a mining machine or vehicle off a stationary track or structure.

A further object of this invention is to provide a novel chainless haulage system which is less sensitive to pitch and alignment.

Yet another object of this invention is to provide a novel chainless haulage system employing an improved guidance system for travel along the long wall face.

Yet another object of this invention is to provide a novel chainless haulage system driven off the long wall face supports rather than off the long wall face conveyor, as is common in the prior art.

These and other objects are achieved by providing a chainless haulage system having at least three pairs of sprocket wheels, each pair disposed on a separate axle with opposed wheels on each axle aligned in a pair of parallel planes. A conventional reversing hydraulic motor is connected to the axle of one pair of sprocket wheels through a gear reduction unit and serves as the drive sprocket wheel. Two other pairs of sprocket wheels are disposed laterally offset from each other and serve as follower sprocket wheels. A pair of endless drive chains each having adjacent chain links in generally perpendicular planes respectively engage sprocket wheels disposed in the parallel planes to form a double strand drive chain. The two endless drive chains are interconnected at every fifth or sixth link thereof by means of a crossbar formed of a pair of opposed chain links integrally connected by a connecting bar, the chain links of the cross bar inserted in series with the links of the endless drive chain. A hollow cylindrical roller is loosely disposed around the connecting bar of the cross bar, and the cross bar and roller combination contact vertical pins which are disposed in a line along wall face, and which can be set into the base of the roof supports of the face or into the side of the conveyor pans associated with the mining operation. The sprocket wheels, the endless drive chains, and the cross bars are contained in a housing which at the bottom thereof running the entire length of the housing includes two guide bars between which is disposed the contact pins which engage the cross bar and roller assembly. Thus the contact pins protrude into the housing between the guide bars and the twin sprockets and twin endless drive chains and thereby provide the tracking, or guidance, of the machine along the face. By producing a rotation of the drive sprocket wheels, a lateral movement of the endless drive chains is produced between the two pairs of follower sprocket wheels, such that the cross bar members connecting the endless drive chains engage the stationary contact pins and exert a force thereagainst such that the housing is thereby propelled along the long wall mining face.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
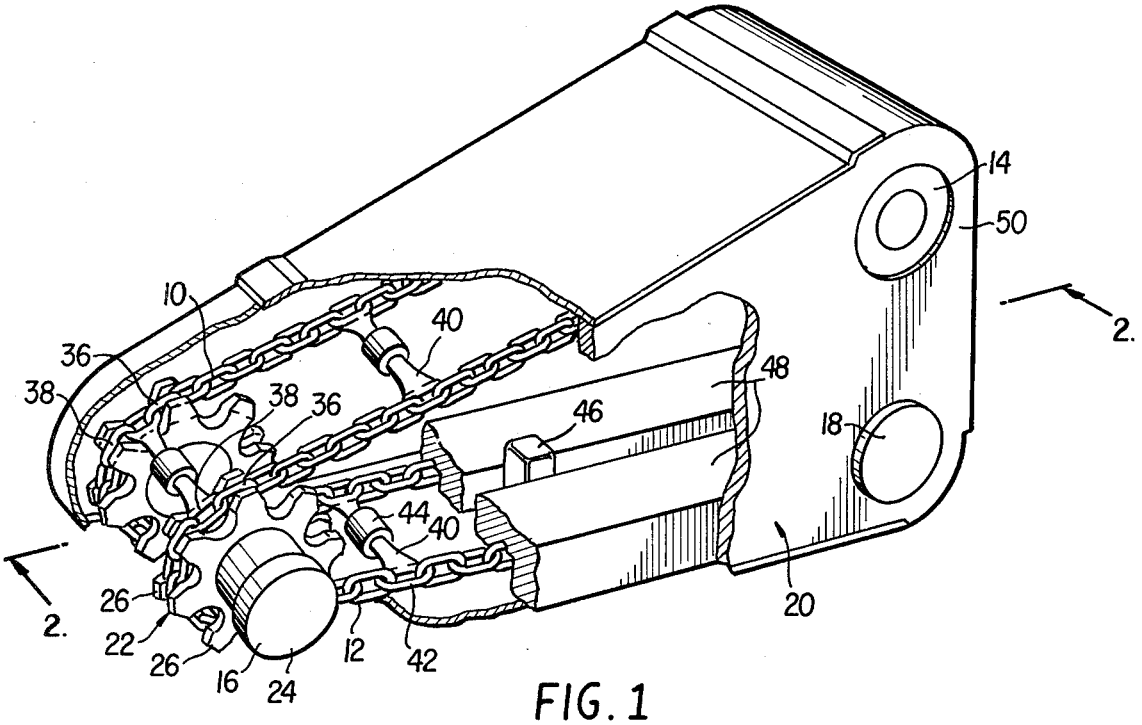
FIG. 1 is a perspective view partly in section of the chainless haulage system according to the invention.

Referring now to the drawings, wherein like reference numerals designate identical or corresponding parts throughout the several views, and more particularly to FIG. 1 thereof, the haulage system according to the invention is seen to employ a pair of endless drive chains 10 and 12 driven by three double sets of conventional sprocket wheels 14, 16 and 18 entirely enclosed in a housing 20 and attached to the body of a coal getting machine (not shown). Each of the double sets of conventional sprocket wheels includes a pair of sprocket wheels 22 longitudinally spaced apart and mounted on an axle 24, each sprocket wheel 22 having a plurality of opposed sprockets 26 disposed circumferentially around the periphery thereof. The double set of sprocket wheels 14 is driven by conventional means (not shown), for example a reversing hydraulic motor, a reversing electric motor or the like, through a conventional gear reduction unit (not shown). The double sets of sprocket wheels 16 and 18 are followers driven by the drive sprocket wheel set 14 by means of the endless drive chains 10 and 12. The double sprockets at 14 are driven by a common thru shaft whereas the double sprockets at 16 and 18 are independently mounted with no connecting shaft.

The opposed sprockets 26 of each sprocket wheel 22 are separated by a distance corresponding to the thickness of an individual chain link 40 of the endless drive chains 10 and 12. Likewise, the circumferential distance between sprockets 26 corresponds generally to the length of each chain link of the drive chains 10 and 12. The drive chains 10 and 12 then are conventionally formed with adjacent chain links in generally perpendicular planes, and engage the sprockets 26 of each sprocket wheel 22 as shown in FIG. 1, with every second link 36 parallel to the sprockets 26 and with adjacent chain links 38 perpendicular to the sprockets 26 and disposed circumferentially therebetween.

As shown in FIG. 1, the endless drive chains and associated sprocket wheels define a pair of parallel planes. The two endless chains 10 and 12 are connected by means of cross bars 40 disposed perpendicular to the plane of the endless chains. Each cross bar 40 is integrally formed with a pair of link members 42 at the opposite ends thereof. The cross bar link member 42 are connected in series with the individual links of the endless drive chains 10 and 12 and engage the sprocket wheels 26 as perpendicular chain links 38. A hollow cylindrical roller 44 is mounted around each cross bar 40 between the cross bar link members 42.

Figure 3:
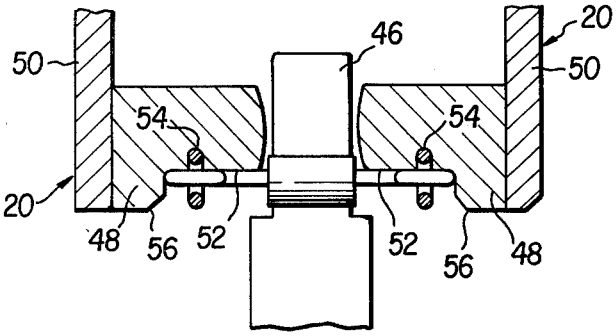
FIG. 3 is a schematic vertical cross-sectional view taken along the lines 3—3 of FIG. 2; and, FIG. 4 is a fragmentory perspective view showing the engagement of a drive cross bar with a drive contact pin, according to the invention.
Figure 4:
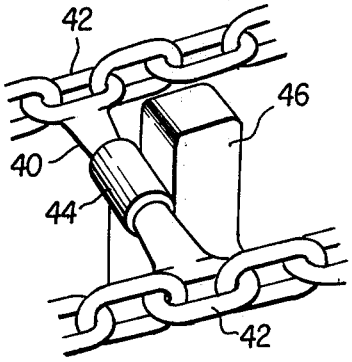

The chainless haulage system according to the invention also includes a plurality of stationary contact pins 46 disposed in a line at common intervals along the long wall mining face. The contact pins 46 are designed to engage the roller 44 of each cross bar 40 as the cross bar 40 moves laterally between the follower sprocket wheel double sets 16 and 18. Therefore, it is necessary to guide the housing 20 along the line of contact pins 46 such that the contact pins 46 are maintained between the endless chains 10 and 12. To that end a pair of guide bars 48 are attached to the side walls 50 of the housing 20. The guide bars 48 extend the entire length of the housing 20 and are separated by a distance corresponding to the width of the contact pins 46, as shown in FIG. 3. Each guide bar 48 has a base surface 52 in which is provided a chain guide groove 54. The groove 54 has a width corresponding to the thickness of the individual chain links of the endless drive chains 10 and 12. The chain guide groove 54 is cut sufficiently deep such that chain links adjacent to the links disposed in the groove 54 are flat against the base surface 52 and essentially parallel thereto. The grooved guide bars 48 thus maintain the parallel chains 10 and 12, cross bar 40, and rollers 44, in alignment with the contact pins 46. As seen in FIG. 3, each guide bar 48 also includes a projection 56 therefrom perpendicular to the base surface 52 and further restricting lateral movement of the endless drive chain 10.

In order to provide relatively smooth propulsion, the distance between cross bars 40 is chosen to be approximately the same as the distance between each of the stationary contact pins 46. In that regard, it is noted that the distance between the stationary contact pins 46 is perferably chosen less than the length of the guide bars 48, such that at least two stationary pins 46 are retained between the guide bars 48 during propulsion of the housing 20.

In addition, there would normally be two complete mechanisms as here described attached to a mining machine. This so as to measure relatively smooth performance and proper machine guidance.

Figure 2:
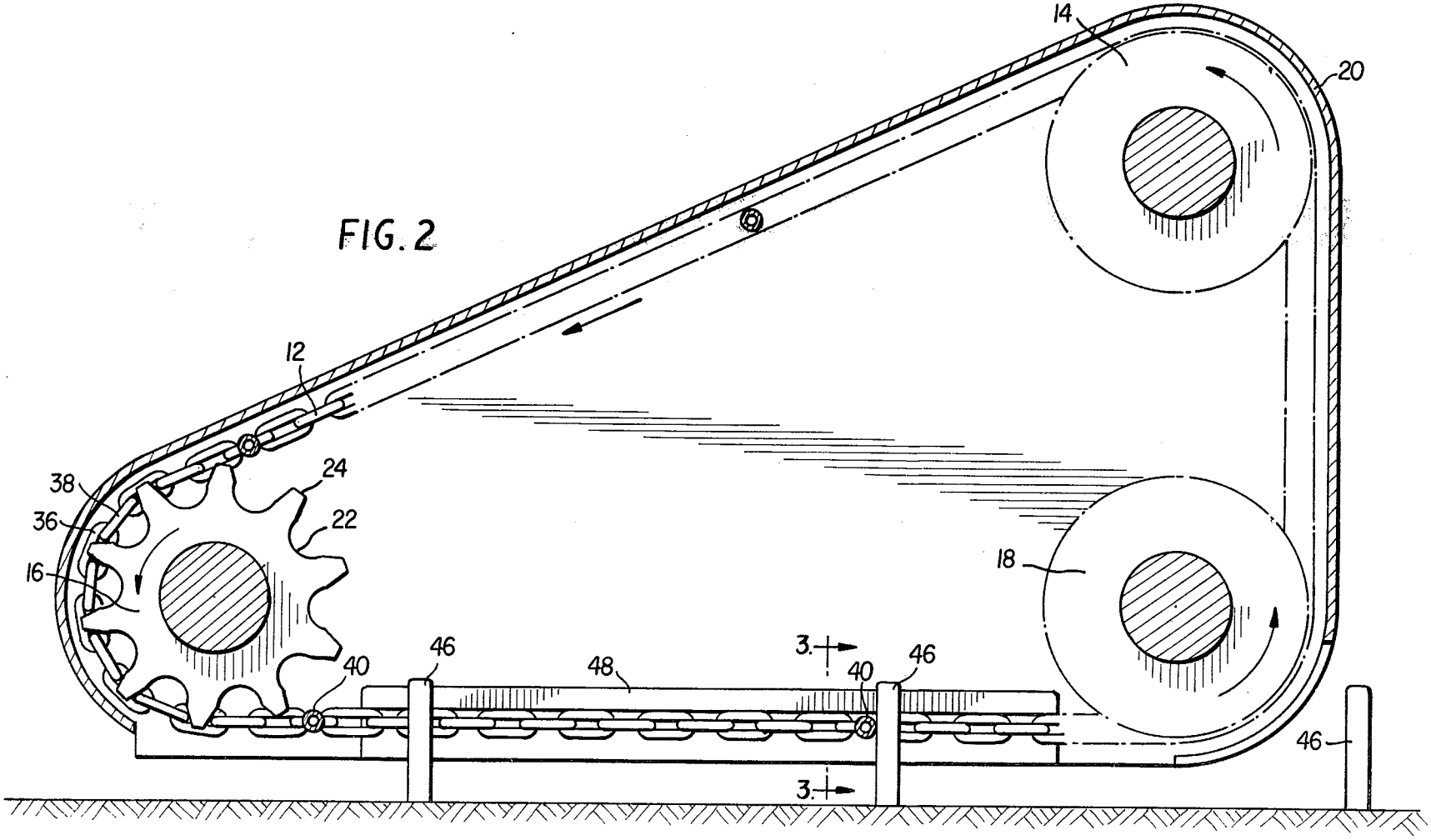
FIG. 2 is a schematic vertical cross-sectional view along the lines 2—2 of FIG. 1.

Operation of the chainless haulage system according to the invention is now described with the aid of FIG. 2. Activation of the drive motor 28 produces a rotation of the endless drive chains 10 and 12 around the double sets of sprocket wheels 14, 16 and 18. As the endless drive chains 10 and 12 are thusly rotated, the cross bars 40 engage the stationary contact pins 46 as the cross bars 40 travel laterally between the sprocket wheel sets 16 and 18. Equal and opposite forces are then exerted by the contact pins 46 and the cross bars 40, and since the contact pins 46 are stationary, the housing 20 is thereby propelled along the long wall mining face.

As shown in FIG. 2, a counterclockwise travel of the endless drive chains 10 and 12 produces a leftward movement of the housing 20. As each contact pin 46 is passed by the housing 20, the cross bars 40 disengage the contact pins 46 as the cross bars 40 travel upwardly from the double sprocket wheel sets 18 to the double sprocket wheel set 14. During this disengagement between the cross bar 40 and the stationary contact pin 46, as well as during the engagement thereof, any translational forces which might otherwise be applied to the cross bar 40, and thereby stress the endless drive chains 10 and 12 through the cross bar link members 42, are instead applied to the loose fitting cross bar roller 44, thereby minimizing the effects of changes in the translational movement of the endless drive chains 10 and 12.

In view of the above description, it is seen that the chainless haulage system according to the invention advantageously employs a double band of high strength alloy endless drive chains which share the load in combination and thereby reduce the stresses in each chain. Also, the use of a specially forged roller mounted cross bar 40 transmits the haulage load to the stationary contact pins 46 which are readily mounted along the long wall face. Unlike other chainless haulage systems, the haulage system according to the invention is not pitch sensitive, and for this reason it can be used to haul the coal getting machine off the line of roof supports. Thus the stationary drive pins can be affixed to the base of the roof supports, however, if so desired the drive pins can likewise be mounted off the face conveyor frame. It is particularly noted that the guide bars 48 guide the housing 20 and therefore also the driven machine (coal cutting machine) along the long wall face from the line of stationary contact pins 46. Thus the haulage system according to the invention is integrally provided with guidance means and does not require a separate guidance system as is commonly found in the prior art. Furthermore, the link-lock haulage system according to the invention is operational in spite of different relative positioning of various drive pins, and as stated above, is in no way pitch sensitive. Thus, the link-lock chainless hauling system is comparatively an extremely rugged but simple mechanism, particularly suited for reliable operation in the hostile environment of a coal mine.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A chainless haulage system for pulling, cutting and loading machines along a longwall mining face, comprising:

at least three pairs of sprocket wheels, each pair disposed on a separate axle with opposed wheels on each axle aligned in a pair of generally parallel planes, at least one of said pairs of wheels being drive wheels, two of said pairs of wheels disposed laterally offset, each sprocket wheel having a plurality of opposed sprockets disposed circumferentially around the periphery thereof;

a pair of endless drive chains both having adjacent chain links in generally perpendicular planes, one of said drive chains engaging sprockets of those sprocket wheels disposed in one of said parallel planes, the other chain engaging sprockets of those sprocket wheels disposed in the other of said parallel planes;

a plurality of spaced connecting crossbars disposed generally perpendicular to said pair of parallel planes to connect said endless chains to each other;

a plurality of stationary vertically oriented contact pins disposed in a line of projected travel at common spaced intervals along said longwall mining face, said line of contact pins being maintained between said endless chains and having sufficient height to contact the crossbars between said laterally offset sprocket wheels;

a common housing containing said pairs of sprocket wheels, said endless chains and said connecting crossbars;

guide means for guiding said housing and its contained parts such that said contact pins are maintained between said endless drive chains;

drive means connected to the axle of said at least one pair of drive sprocket wheels for rotating said sprocket wheels;

whereby rotation of said pair of drive sprocket wheels produces a lateral movement of said two pairs of laterally offset sprocket wheels, said crossbars moving between said laterally disposed pairs of sprocket wheels to engage said stationary contact pins and exert a force thereagainst such that said housing and its contents is propelled by force along said longwall mining face in the line of projected travel formed by the pins.

2. A system according to claim 1, wherein said guide means comprises:

a pair of guide bars attached to said housing and separated by a distance corresponding to the width of said contact pins and having a length longer than said common interval between drive pins, said contact pins disposed between said guide bars;

whereby said housing is propelled in the direction of said contact pins.

3. A system according to claim 2, wherein each of said guide bars comprises:

a base surface; and, a guide groove disposed in said base surface, said groove having a width corresponding to the thickness of the links of said endless chains and a depth sufficiently deep such that atlernate chain links are guided in said groove and chain links adjacent the so guided chain links and perpendicular thereto engage said base surface and are parallel thereto.

4. A system according to claim 3, wherein each of said guide bars further comprises at least one projection along the length thereof such that chain links parallel to said base surface are guided by said projection.

5. A system according to claim 1, wherein each of said crossbar comprises:

a pair of opposed chain link members integrally connected by a connecting bar, one of said opposed chain link members forming an individual chain link of said one of said endless drive chains, the other of said opposed chain link members forming an individual chain link of said other of said endless drive chains.

6. A system according to claim 5, wherein each of said crossbars comprises:

a hollow cylindrical roller loosely disposed around said connecting bar, said roller contacting said contact pin during propulsion of said housing.

* * * * *